US009232842B2

(12) United States Patent
Ishida

(10) Patent No.: US 9,232,842 B2
(45) Date of Patent: Jan. 12, 2016

(54) PAIR OF HAIR TWEEZERS

(75) Inventor: Takuya Ishida, Las Vegas, NV (US)

(73) Assignee: KOWASHOJI CO., LTD, Shibuya-Ku, Tokyo (JP)

( * ) Notice: Subject to any disclaimer, the term of this patent is extended or adjusted under 35 U.S.C. 154(b) by 364 days.

(21) Appl. No.: 13/807,328

(22) PCT Filed: Jul. 9, 2010

(86) PCT No.: PCT/JP2010/061687
§ 371 (c)(1),
(2), (4) Date: Dec. 28, 2012

(87) PCT Pub. No.: WO2012/004885
PCT Pub. Date: Jan. 12, 2012

(65) Prior Publication Data

US 2013/0110133 A1 May 2, 2013

(51) Int. Cl.
*A61B 17/30* (2006.01)
*A45D 26/00* (2006.01)

(52) U.S. Cl.
CPC ..... *A45D 26/0066* (2013.01)

(58) Field of Classification Search
CPC ..... A45D 26/0066; A45D 29/18; B25B 9/02; A61C 3/00; A61C 7/146; A61B 17/30
USPC ..... 606/131, 133, 210
See application file for complete search history.

(56) References Cited

U.S. PATENT DOCUMENTS 1,701,995 A 2/1929 Anderson
5,868,787 A * 2/1999 Kim ..... 606/211
(Continued)

FOREIGN PATENT DOCUMENTS

DE 1915224 U 5/1965
EP 1080657 A 3/2001
(Continued)

OTHER PUBLICATIONS

International Search Report (PCT/ISA/210) issued on Aug. 17, 2010, by the Japanese Patent Office as the International Searching Authority for International Application No. PCT/JP2010/061687.
(Continued)

*Primary Examiner* — Victor Nguyen
(74) *Attorney, Agent, or Firm* — Buchanan Ingersoll & Rooney PC

(57) ABSTRACT

Hair tweezers have a bend section from which a pair of opposing plate-shaped gripping sections extend in the longitudinal direction, and opposing gripping surfaces are respectively formed on the ends of the gripping sections which are located on the side facing the bend section. The hair tweezers do not cause a problem in that, when the hair tweezers are in use, the ends on the side on which the gripping surfaces are formed are displaced relative to each other in the vertical direction, which intersects the longitudinal direction, to make it difficult for the user to grip a targeted unwanted hair. The thickness of a bend portion is equal to or greater than the thickness of the portions of a pair of gripping sections which are not included in the bend section. The pair of gripping sections are respectively provided with thin sections, which have a small thickness, located between the bend section and the ends having the gripping surfaces formed thereon.

3 Claims, 4 Drawing Sheets

(56) References Cited

U.S. PATENT DOCUMENTS

| | | | | |
|---|---|---|---|---|
| 7,229,111 | B2 * | 6/2007 | Cohen et al. | 294/99.2 |
| 2006/0175853 | A1 | 8/2006 | Anderson et al. | |

FOREIGN PATENT DOCUMENTS

| | | | |
|---|---|---|---|
| JP | 64-40302 | U | 3/1989 |
| JP | 3027591 | U | 8/1996 |
| JP | 2007-082923 | A | 4/2007 |
| JP | 2007-229386 | A | 9/2007 |

OTHER PUBLICATIONS

Supplemental European Search Report, dated Nov. 3, 2013, in corresponding European Patent Application No. 10 85 4439 (6 pages).

* cited by examiner

PAIR OF HAIR TWEEZERS

BACKGROUND

1. Technical Field

The present invention relates to a pair of hair tweezers that are used in picking up and then pulling out any unwanted hairs or any other small things such as splinters, thorns and the like.

2. Description of the Prior Art

The conventional pair of hair tweezers that are known to the prior art will be explained below by using FIG. 1.

In general, the conventional hair tweezers 1 include a bend section 2 and a pair of opposing plate-shaped gripping sections 3*a*, 3*b* that are bent at the bend portion 2 from which the gripping sections 3*a*, 3*b* extend in the longitudinal direction, wherein the pair of opposing gripping surfaces 5*a*, 5*ba* that are provided to face opposite each other are formed on the lateral end edges 4*a*, 4*b* of the corresponding gripping sections 3*a*, 3*b* which are located on the side facing the bend section 2.

Using the conventional hair tweezers, the user may grip the gripping sections 3*a*, 3*b* with his or her fingers, bringing the lateral end edges 4*a*, 4*b* of the gripping sections 3*a*, 3*b* closer to each other against the action of their elastic forces and in the directions shown by arrows 6*a*, 6*b*. In this way, any unwanted hair or the like can be pulled out by picking up or holding the hair or the like located between the pair of gripping surfaces 5*a*, 5*b*. During this operation, the elastic force can be provided by the pair of opposing plate-shaped gripping sections 3*a*, 3*b* that are bent at the bend section 2 and extend from the bend section 2 toward the longitudinal direction.

Various types of the hair tweezers described above have been proposed until the present time (such as Patent Documents 1 and 2).

PRIOR PATENT DOCUMENTS

Patent Document 1: Patent Application No. 2007-82923

Patent Document 2: Patent Application No. 2007-229386

SUMMARY OF THE INVENTION

In the conventional pair of tweezers described above, it is general that the bend section 2 has the thickness W1 that is smaller than the thickness W2 of that part of each of the gripping sections 3*a*, 3*b* which is located in the portion other than the bend section 2 so that the elastic force can be ensured and so that the hair tweezers can be used smoothly.

For the relative thickness of W1<W2 such as the one described above, any attempt that is made to pick up the gripping sections 3*a*, 3*b* with the fingers and then to bring the lateral end edges 4*a*, 4*b* of the gripping sections 3*a*, 3*b* closer to each other toward the directions shown by the arrows 6*a*, 6*b* would cause the lateral end edges 4*a*, 4*b* to be displaced relative to each other toward the directions shown by arrows 7*a*, 7*b* or the directions opposite the arrows 7*a*, 7*b* because of the smaller thickness of the bend section 2. If this should occur, that is, if the lateral end edges 4*a*, 4*b* should be displaced relative to each other in the vertical direction across the longitudinal direction in which the gripping sections 3*a*, 3*b* extend, there is a problem in that the user would not be able to grip or pick up any unwanted hairs with the gripping surfaces 5*a*, 5*b* as intended by the user.

Accordingly, the present invention proposes to provide a pair of hair tweezers (which may simply be called the hair tweezers) that includes a bend section, a pair of opposing plate-shaped gripping sections bent at the bend section and extending toward the longitudinal direction, and a pair of opposing gripping surfaces formed on the lateral end edges of the corresponding gripping sections that are located on the side facing opposite the bend section, wherein, when the hair tweezers are being used, the hair tweezers are designed so that the lateral end edges located on the side on which the gripping surfaces are formed will not be displaced relative to each other in the vertical direction across the longitudinal direction and so that any targeted unwanted hairs can be gripped or picked up securely by the pair of gripping sections, thus avoiding the problem associated with the prior art pair of hair tweezers as described above.

An exemplary embodiment of the disclosure provides a pair of hair tweezers that include a bend section, a pair of opposing plate-shaped gripping sections bent at the bend section and extending toward the longitudinal direction, and a pair of opposing gripping surfaces that are provided for facing opposite each other, each of which is formed on the lateral end edge of the corresponding gripping section that is located on the side facing opposite the bend section, wherein the bend section has the thickness that is equal to or greater than the thickness of that part of each of the gripping sections which is located in the portion other than the bend section, and each of the pair of gripping sections includes a thin portion having a smaller thickness and located between the bend section and the lateral end edge of the corresponding gripping section on which the corresponding gripping surface is formed.

An exemplary embodiment of the disclosure provides the pair of hair tweezers wherein at least either of the lateral end edges of the pair of gripping sections on which the gripping surfaces are formed has its top end being chamfered toward the direction across the longitudinal direction.

In accordance with the present invention, the pair of hair tweezers or simply the hair tweezers include the bend section, the pair of opposing plate-shaped gripping sections bent at the bend section and extending in the longitudinal direction, and the pair of gripping surfaces that are provided for facing opposite each other and are formed on the lateral end edges of the corresponding gripping sections that are located on the side facing opposite the bend section, wherein, when the pair of hair tweezers are being used, the hair tweezers are designed so that the lateral end edges formed on the gripping surfaces will not be displaced relative to each other in the vertical direction across the longitudinal direction and so that any unwanted hairs or the like can be picked up and then pulled out securely by the pair of gripping sections, thereby preventing the problem associated with the prior art from occurring. It may be appreciated from the above description that the present invention provides an excellent easy-to-use hair tweezers. Using this pair of hair tweezers, therefore, the user can pick up and then pull out any unwanted hairs or the like securely as intended by the user.

In accordance with the present invention, the pair of hair tweezers are also designed so that at least either of the lateral end edges of the pair of gripping sections on which the gripping surfaces are formed has its top end being chamfered toward the direction across the longitudinal direction. Using the pair of hair tweezers, therefore, the user can pick up and then pull out any unwanted hairs or the like without causing the skin to be damaged.

BEST MODE OF EMBODYING THE INVENTION

Now, one preferred embodiment of the present invention will be described below by referring to the accompanying drawings.

Figure 1:
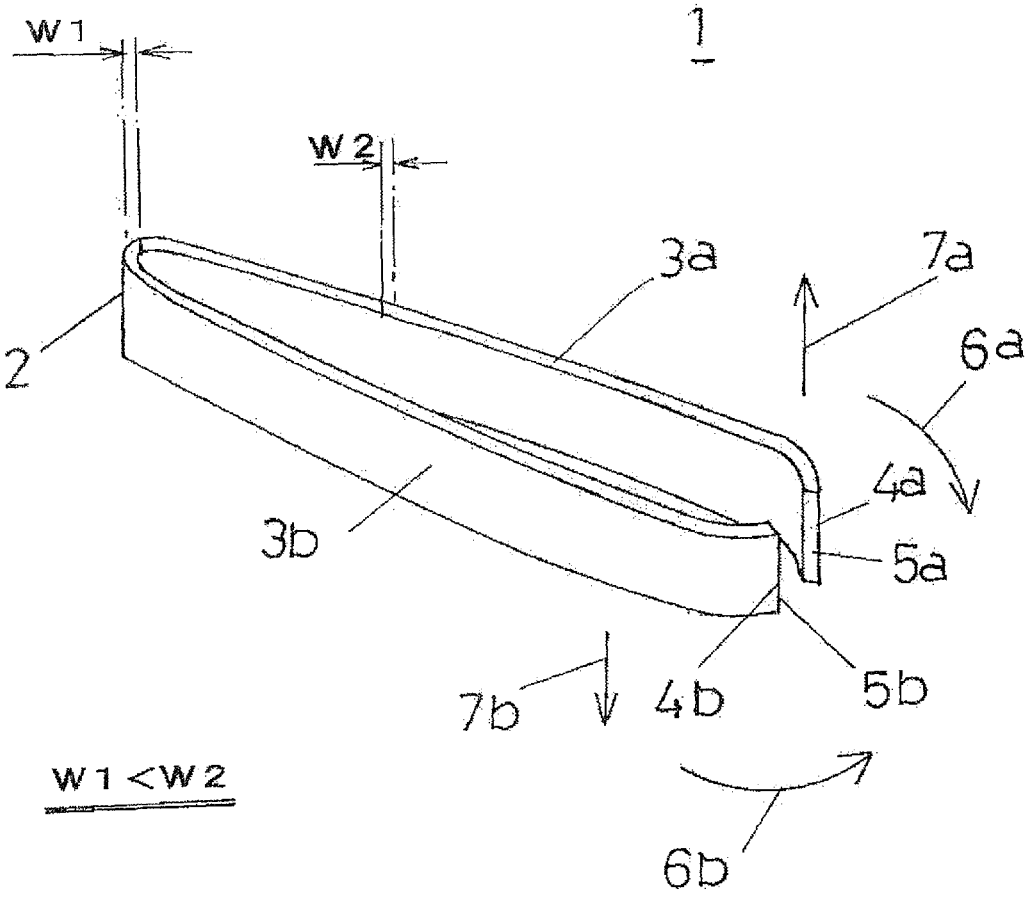
FIG. 1 is a perspective view illustrating one example of the prior art pair of hair tweezers.

It should be noted that the components that are common to those of the prior art pair of hair tweezers 1 that have been described by using FIG. 1 are given common or same reference numerals, and will not be described any further.

Figure 2:
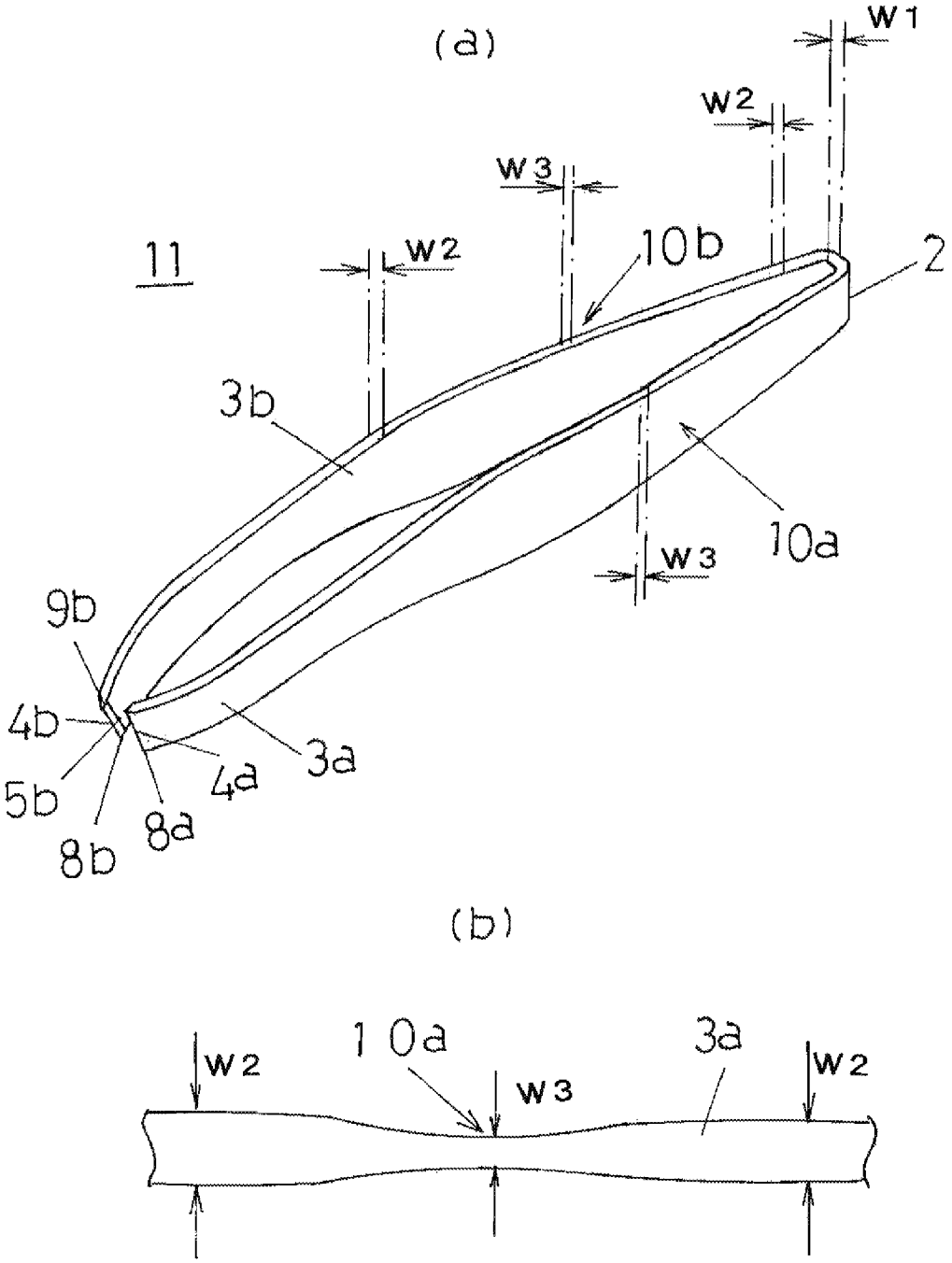
FIG. 2 (*a*) is a perspective view illustrating one example of the inventive pair of hair tweezers, and FIG. 2 (*b*) is a plan view illustrating the thin portion formed on each of the gripping sections although some parts are omitted.
Figure 3:
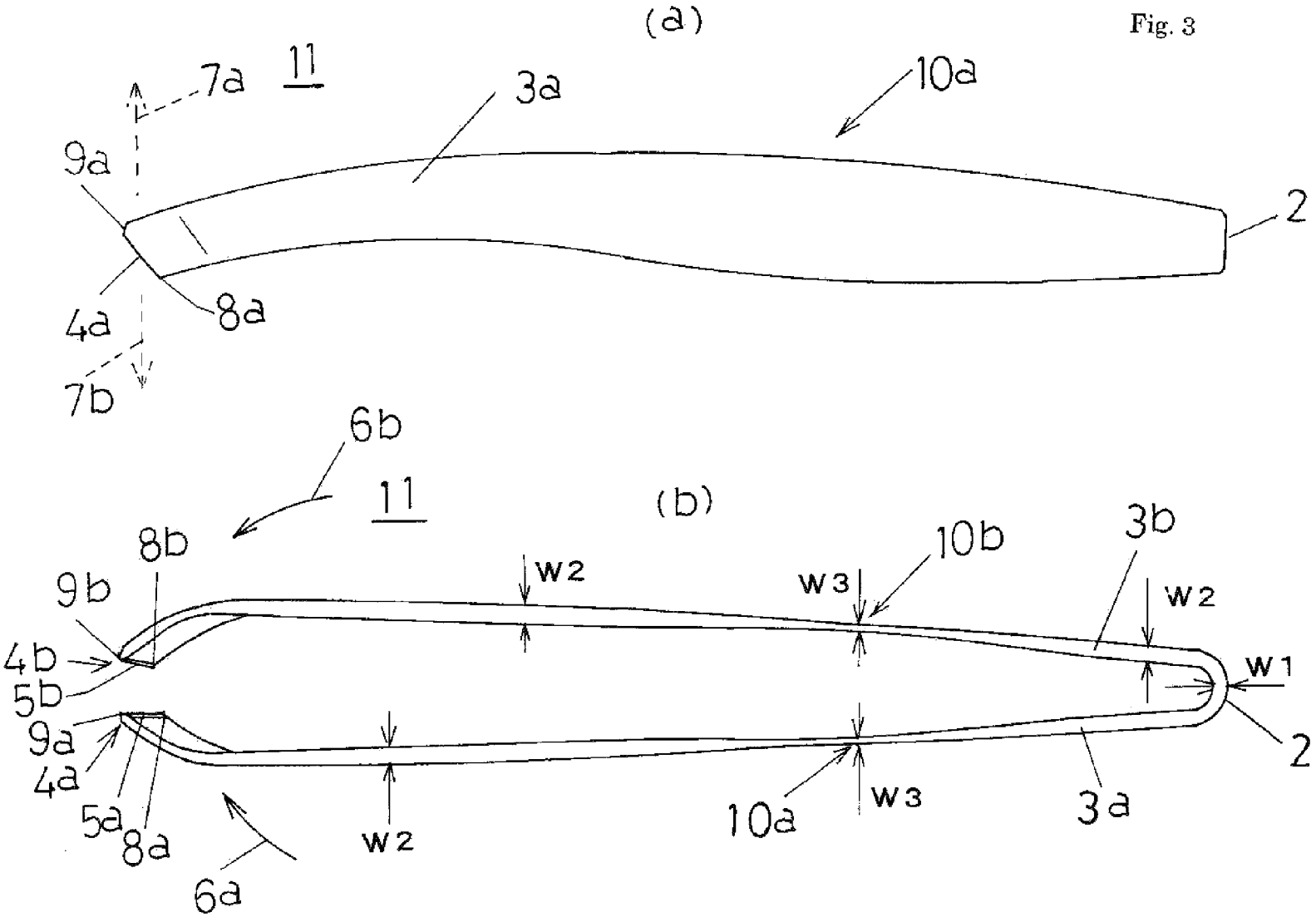
FIG. 3 (*a*) is a side elevation view for one of the pair of gripping sections in the inventive pair of hair tweezers, and FIG. 3 (*b*) is a plan view for the pair of gripping sections in the inventive pair of hair tweezers.
Figure 4:
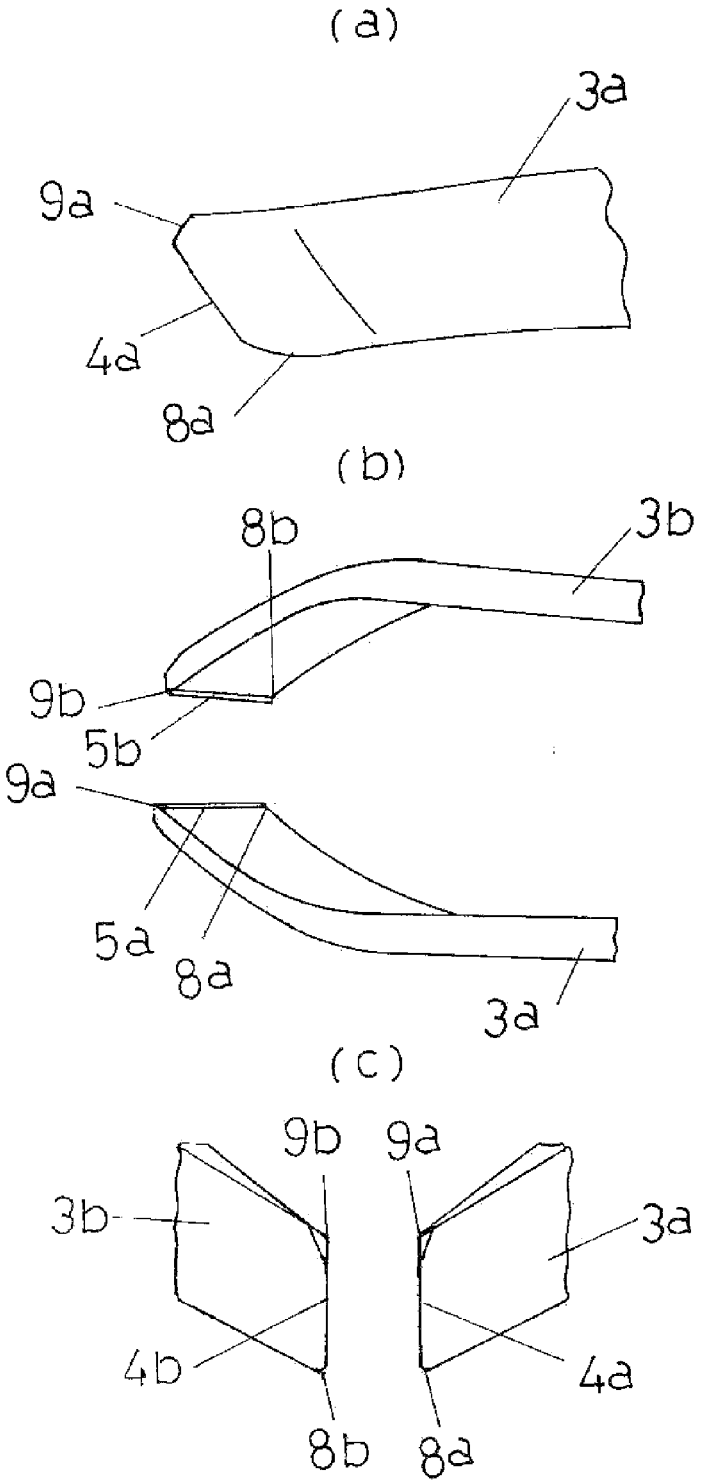
FIG. 4 (*a*) is an enlarged side elevation view illustrating one of the lateral end edges of the gripping sections in the inventive pair of hair tweezers, and FIG. 4 (*b*) is an enlarged plan view illustrating the lateral end edges of the gripping sections in the inventive pair of hair tweezers, and FIG. 4 (*c*) is an enlarged front view illustrating the lateral end edges of the gripping sections in the inventive pair of hair tweezers.

The pair of hair tweezers 11 of the present invention (which may simply be called as the hair tweezers) include a bend section 2 and a pair of opposing plate-shaped gripping sections 3*a*, 3*b* bent at the bend section 2 and extending in the longitudinal direction (FIG. 2 (*a*), FIG. 3 (*b*)). The pair of hair tweezers further include a pair of gripping surfaces 5*a*, 5*b* that are provided for facing opposite each other, wherein each of the gripping surfaces 5*a*, 5*b* is formed on the lateral end edge 4*a* or 4*b* of the corresponding gripping section 3*a* or 3*b* that is located on the side facing opposite the bend section 2 (FIG. 3 (*b*), FIG. 4 (*b*)).

In the pair of hair tweezers 11 of the present invention, the bend section 2 has the thickness W1 that is equal to or greater than the thickness W2 of that part of the corresponding gripping section 3*a* or 3*b* which is located in the portion other than the bend section 2 (FIGS. 2 (*a*) and (*b*), FIG. 3 (*b*)).

In addition, each of the gripping sections 3*a*, 3*b* has a thin portion 10*a*, 10*b* whose thickness W3 between the bend section 2 and the lateral end edge 4*a*, 4*b* on which the corresponding gripping surface 5*a* or 5*b* is formed is less thick than the thickness W2 of that part of the corresponding gripping section 3*a* or 3*b* which is located in the portion other than the bend section 2.

When the pair of hair tweezers 11 are being used, the user may grip the gripping sections 3*a*, 3*b* with his or her fingers and then bring the lateral end edges 4*a*, 4*b* of the gripping sections 3*a*, 3*b* closer to each other in the directions shown by the arrows 6*a*, 6*b* in FIG. 3 (*b*), picking up any unwanted hairs or the like located between the pair of lateral end edges 4*a*, 4*b* facing opposite each other and then pulling them out so that they can be removed. After the hairs or the like have been pulled out or removed, the user may release the force that has been applied to the gripping sections 3*a*, 3*b*, moving the lateral end edges 4*a*, 4*b* toward the directions opposite the arrows 6*a*, 6*b* in order to be detached away from each other. In this way, the lateral end edges 4*a*, 4*b* will be restored to their respective original positions as shown in FIG. 2 (*a*), FIG. 3 (*b*).

When the force is applied to the gripping sections 3*a*, 3*b* in order to bring the lateral end edges 4*a*, 4*b* of the gripping sections 3*a*, 3*b* closer to each other in the directions shown by the arrows 6*a*, 6*b*, thereby picking up any unwanted hairs or the like located between the pair of the gripping surfaces 5*a*, 5*b* facing opposite each other and then pulling them out so that they can be removed, or when the applied force is released from the gripping sections 3*a*, 3*b* to move the lateral end edges 4*a*, 4*b* toward the directions opposite the arrows 6*a*, 6*b* in order to be detached away from each other, moving the lateral end edges 4*a*, 4*b* back to their respective original positions, the elastic force of the hair tweezers 11 as required will be provided.

In the pair of hair tweezers 11 of the present invention, the elastic force of the hair tweezers 11 as described above can be provided by the respective thin portions 10*a*, 10*b* formed on the middle way of the gripping sections 3*a*, 3*b*.

In the pair of hair tweezers 11 of the present invention, however, it may be understood that the bend section 2 has the thickness W1 that is equal to or greater than the thickness W2 of that part of each corresponding gripping section 3*a* or 3*b* which is located in the portion other than the bend section 2 (FIGS. 2 (*a*) and (*b*), FIG. 3 (*b*)).

During the use of the pair of hair tweezers 11, then, the pair of gripping sections 3*a*, 3*b* may be gripped by the fingers as described above so that the lateral end edges 4*a*, 4*b* of the gripping sections 3*a*, 3*b* can be brought closer to each other as shown by the arrows 6*a*, 6*b* in FIG. 3 (*b*) and so that any unwanted hair or the like can be picked up between the pair of lateral end edges 4*a*, 4*b*. During the above operation, therefore, there is no risk that the lateral end edges 4*a*, 4*b* might be displaced relative to each other in the vertical direction shown by the arrows 7*a*, 7*b* when they are pivoted around the bend portion 2.

When the pair of hair tweezers 11 are being used, therefore, there is no risk that the lateral end edges 4*a*, 4*b* on the side on which the gripping surfaces 5*a*, 5*b* are formed might be displaced relative to each other in the vertical direction across the longitudinal direction in which the gripping sections 3*a*, 3*b* extend. This will avoid the situation in which the lateral end edges 4*a*, 4*b* will be displaced relative to each other as described above and therefore any unwanted hairs or the like will not be able to be picked up securely as intended by the user.

In the conventional pair of hair tweezers 1 such as the one described above and shown in FIG. 1, however, the bend section 2 is provided so that it can have the thickness W1 that is smaller than the thickness W2 of that part of each corresponding gripping sections 3*a* or 3*b* that is located in the portion other than the bend section 2. For this reason, any attempt that is then made to grip the pair of gripping sections 3*a*, 3*b* with the fingers and then to bring the lateral end edges 4*a*, 4*b* closer to each other in the directions shown by the arrows 6*a*, 6*b* would cause the lateral end edges 4*a*, 4*b* to be displaced relative to each other in the vertical direction (arrows 7*a*, 7*b*) across the longitudinal direction in which the gripping sections 3*a*, 3*b* extend. This is because of the smaller thickness of the bend section 2. Thus, the conventional hair tweezers present the problem in that any unwanted hair or the like cannot be picked up securely by the pair of gripping surfaces 5*a*, 5*b* as intended by the user.

For the pair of hair tweezers 11 according to the present invention, on the contrary, each of the pair of gripping sections 3*a*, 3*b* extending in the longitudinal direction includes the less thick portion that is formed on the middle way thereof, which ensures the elastic force that will be required when the hair tweezers are being used. This eliminates the need of making the bend section 2 less thick in order to ensure such elastic force. It is thus possible to provide the bend section 2 having the thickness W1 that is equal to or greater than the thickness W1 of that part of each corresponding gripping section 3*a* or 3*b* which is located in the portion other than the bend section 2. When the hair tweezers 11 of the present invention are being used, therefore, there is no risk that the lateral end edges 4*a*, 4*b* on the side on which the gripping surfaces 5*a*, 5*b* are formed might be displaced relative to each other in the vertical direction (arrows 7*a*, 7*b*) across the longitudinal direction in which the gripping sections 3*a*, 3*b* extend.

It may be appreciated from the above description that each of the pair of gripping sections 3*a*, 3*b* of the present invention extending in the longitudinal direction includes the less thick portion 10*a*, 10*b* formed on the middle way thereof in order to ensure the elastic force that will be required when the hair tweezers 11 are being used. In accordance with the present invention, it is intended that the fact that the bend section 2 has the thickness W1 that is equal to or greater than the thickness W2 of that part of each corresponding gripping section 3*a* or 3*b* which is located in the portion other than the bend section 2 means that the bend section 2 has the thickness W1 that is equal to or greater than the thickness W2 of that part of each corresponding gripping section 3*a* or 3*b* which is located in the portion other than each corresponding less thick portion 10*a* or 10*b*. As one example, the requirement described above can be met by providing the bend section 2 so that it can have the thickness W1 that is equal to or greater than the thickness W2 of that part of each corresponding gripping section 3*a* or 3*b* which is located in the neighborhood of the bend section 2.

In the pair of hair tweezers 11 of the present invention, at least either of the top ends of the lateral end edges 4*a*, 4*b* of the pair of gripping sections 3*a*, 3*b* on which the gripping surface 5*a*, 5*b* are formed is chamfered in the direction across the longitudinal direction in which the gripping sections 3*a*, 3*b* extend.

The pair of hair tweezers 11 according to the embodiment of the present invention shown may be used by the user gripping the pair of gripping sections 3*a*, 3*b* with his or her fingers in the state in which the hair tweezers 11 are placed as shown in FIG. 2 (*a*). As it is seen from FIG. 2 (*a*), the top ends 8*a*, 8*b* that will be directed downwardly at this moment are chamfered.

In accordance with the pair of hair tweezers 11 of the present invention, the chamfered top ends 8*a*, 8*b* of the gripping sections 3*a*, 3*b* can be used to pick up and then pull out any unwanted hairs or the like that are located where they cannot be picked up and then pulled out. This operation can also be performed without causing the user's skin to be damaged.

It should be noted that the top ends 9*a*, 9*b* located opposite the corresponding top ends 8*a*, 8*b* may also be chamfered.

The pair of hair tweezers 11 of the present invention are usually made of metal, but they may be made of any non-metal materials that provide the above-described elastic force as well as the functions required for pulling out the hairs or the like.

Although the particular preferred embodiment of the present invention has been described by reference to the accompanying drawings, it should be understood that the present invention is not limited to the particular embodiment but various modifications, alterations and changes may be made without departing from the spirit and scope as defined in the appended claims.

1 Prior Art Hair Tweezers
2 Bend Section
3*a*, 3*b* Gripping Sections
4*a*, 4*b* Lateral End Edges
5*a*, 5*b* Gripping Surfaces
8*a*, 8*b*, 9*a*, 9*b* Top Ends
10*a*, 10*b* Thin Portions
11 Inventive Hair Tweezers

The invention claimed is:

1. A pair of hair tweezers comprising:

a bend section;

a pair of opposing plate-shaped gripping sections bent at said bend section and extending toward a longitudinal direction; and a pair of opposing gripping surfaces that are provided for facing opposite each other, each of which is formed on a lateral end edge of a corresponding gripping section that is located on a side facing opposite said bend section, wherein said bend section has a thickness that is equal to or greater than a thickness of that part of each of said pair of gripping sections which is located in a portion other than said bend section, and each of said pair of gripping sections includes a thin portion having a smaller thickness than said bend section, said thin portion located between said bend section and the lateral end edge of said corresponding gripping section on which said corresponding gripping surface is formed.

2. The pair of hair tweezers as defined in claim 1, wherein at least either of the lateral end edges of said pair of gripping sections on which said gripping surfaces are formed has its top end being chamfered toward the direction across the longitudinal direction.

3. The pair of hair tweezers as defined in claim 1, wherein the thin portion of each of said pair of gripping sections has a thickness smaller than other portions of said corresponding gripping section.

* * * * *